US005655880A

United States Patent [19]

Su et al.

[11] Patent Number: 5,655,880

[45] Date of Patent: Aug. 12, 1997

[54] MUSIC BOX MODULE FOR A CEILING FAN

[76] Inventors: Chih-hai Su, No. 72-10, Chianan Li, Shanhua Chen, Tainan Hsien; Kuo-chin Shieh, No. 147-1, Shuiyuan Rd., Fengyuan City, Taichung Hsien, both of Taiwan

[21] Appl. No.: 706,131

[22] Filed: Aug. 30, 1996

[51] Int. Cl.[6] ..... F04D 29/00

[52] U.S. Cl. ..... 416/146 R; 416/5; 416/244 R

[58] Field of Search ..... 416/5, 146 R, 416/170 R, 244 R; 84/94.1, 94.2, 95.1, 95.2; 362/96; 403/335, 338, 375; 446/404

[56] References Cited

U.S. PATENT DOCUMENTS

| | | | |
|---|---|---|---|
| 4,863,346 | 9/1989 | Lin | 416/5 |
| 4,872,387 | 10/1989 | Melia | 84/95.2 |
| 5,462,412 | 10/1995 | Scofield et al. | 416/5 |

FOREIGN PATENT DOCUMENTS

| | | | |
|---|---|---|---|
| 0809601 | 3/1937 | France | 416/170 R |

*Primary Examiner*—Christopher Verdier

*Attorney, Agent, or Firm*—Kirkpatrick & Lockhart LLP

[57] ABSTRACT

A music box module is attached to a ceiling fan having a control box mounted on an underside thereof and at least one hole defined in a periphery of the control box. The music box module includes a music box mounted in the control box and having at least one slot defined in a periphery thereof and aligning with the hole. A supporting base is mounted on an underside of the music box and has at least one flange extending upwardly from a periphery thereof to be received in an inner wall of the music box. A bore is defined by a threaded portion of the flange and aligns with the slot. A positioning member extends through the hole, the slot and is securely engaged in the bore.

4 Claims, 3 Drawing Sheets

MUSIC BOX MODULE FOR A CEILING FAN

FIELD OF THE INVENTION

The present invention relates to a music box module, and more particularly to a music box module for a ceiling fan.

BACKGROUND OF THE INVENTION

A conventional ceiling fan comprises a plurality of rotary blades and a control box mounted on an underside of the plurality of rotary blades. The control box contains a switch therein for controlling rotation of the plurality of rotary blades. By such an arrangement, however, most of the space in the control box is not used efficiently, thereby greatly causing a waste of the space therein.

The present invention has arisen to mitigate and/or obviate the disadvantage of the conventional ceiling fan.

SUMMARY OF THE INVENTION

In accordance with one aspect of the present invention, there is provided a music box module attached to a ceiling fan which includes a control box mounted on an underside thereof and at least one hole defined in a periphery of the control box.

The music box module includes a music box mounted in the control box and having at least one slot defined in a periphery thereof and aligning with the hole. A supporting base is mounted on an underside of the music box and has at least one flange extending upwardly from a periphery thereof to be received in an inner wall of the music box. A bore is defined by a threaded portion of the flange and aligns with the slot. A positioning member extends through the hole, the slot, and is securely engaged in the bore.

Further features of the present invention will become apparent from a careful reading of the detailed description with reference to the accompanying drawings.

DETAILED DESCRIPTION OF THE PREFERRED EMBODIMENTS

Figure 1:
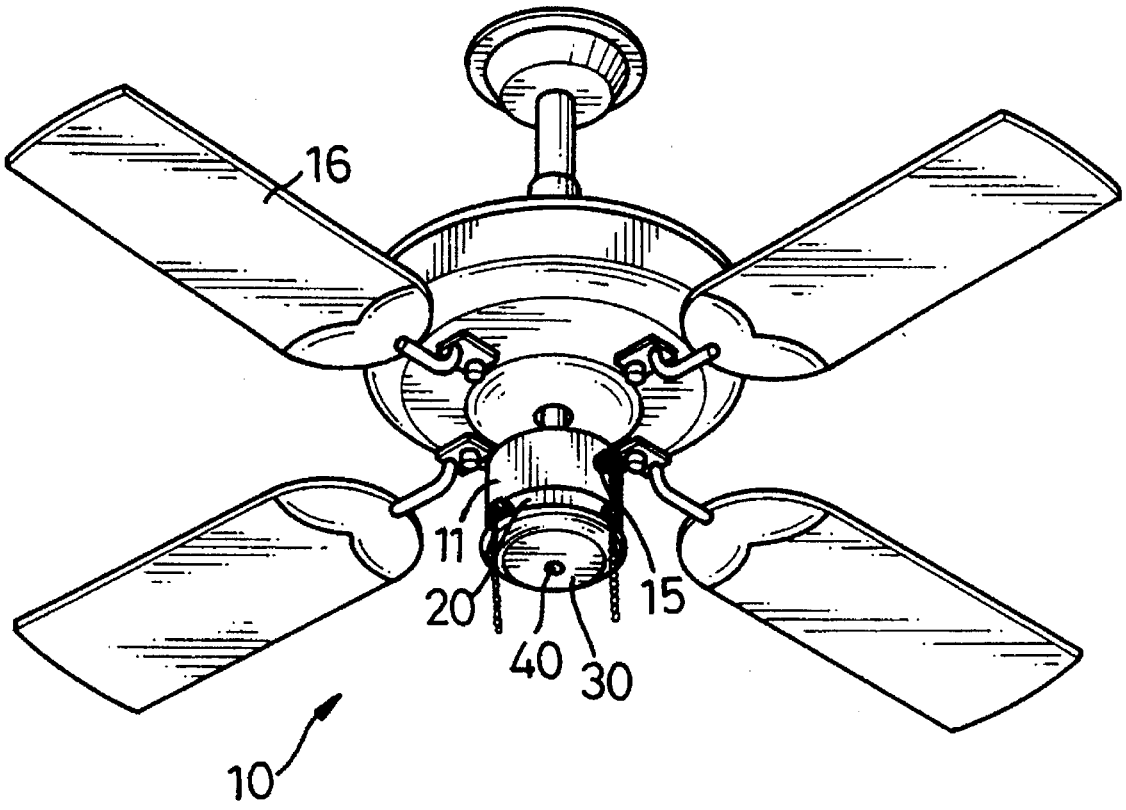
FIG. 1 is a perspective view showing a music box module in accordance with the present invention being attached to a ceiling fan.
Figure 2:
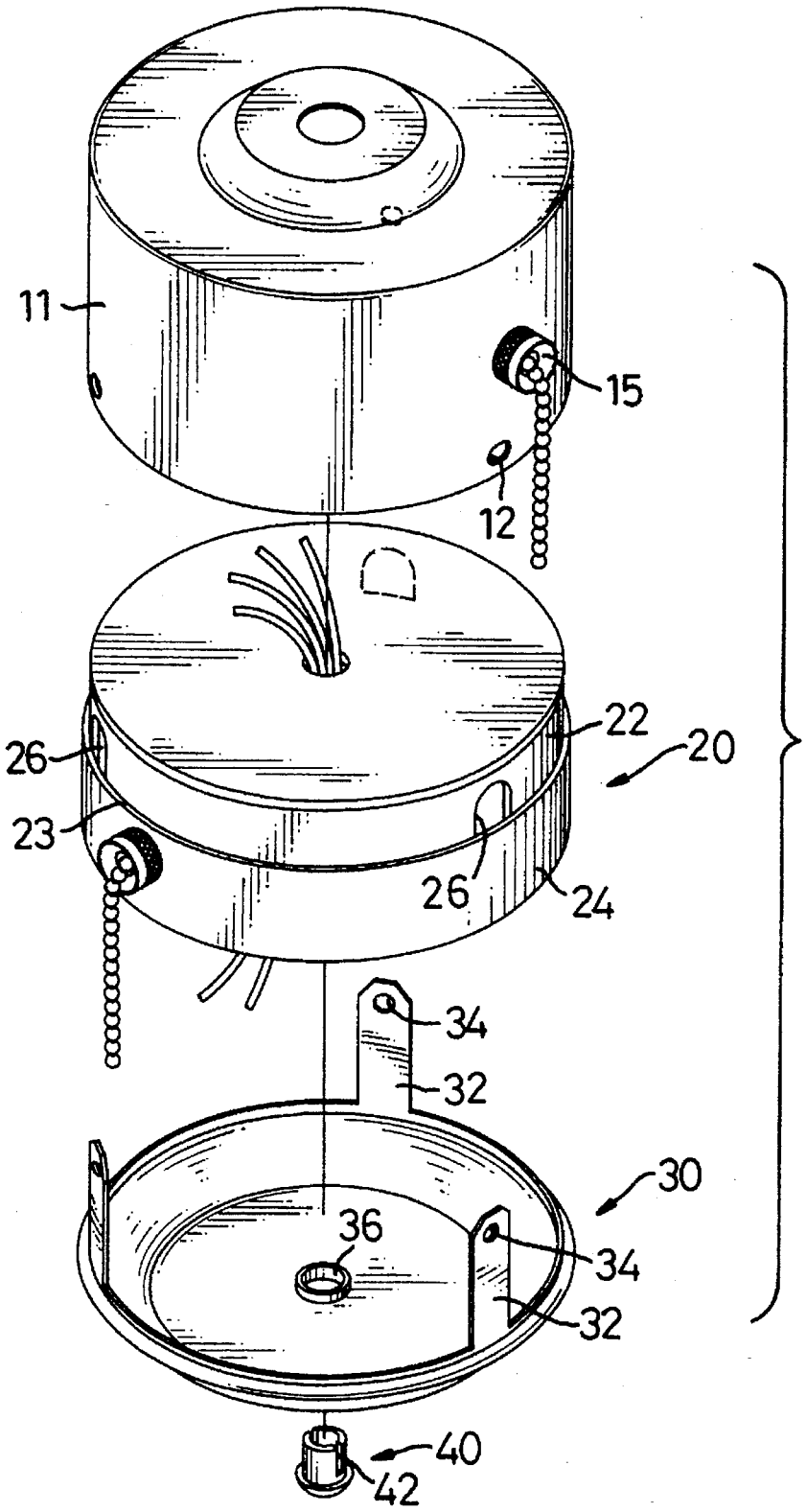
FIG. 2 is an exploded view of the music box module.
Figure 3:
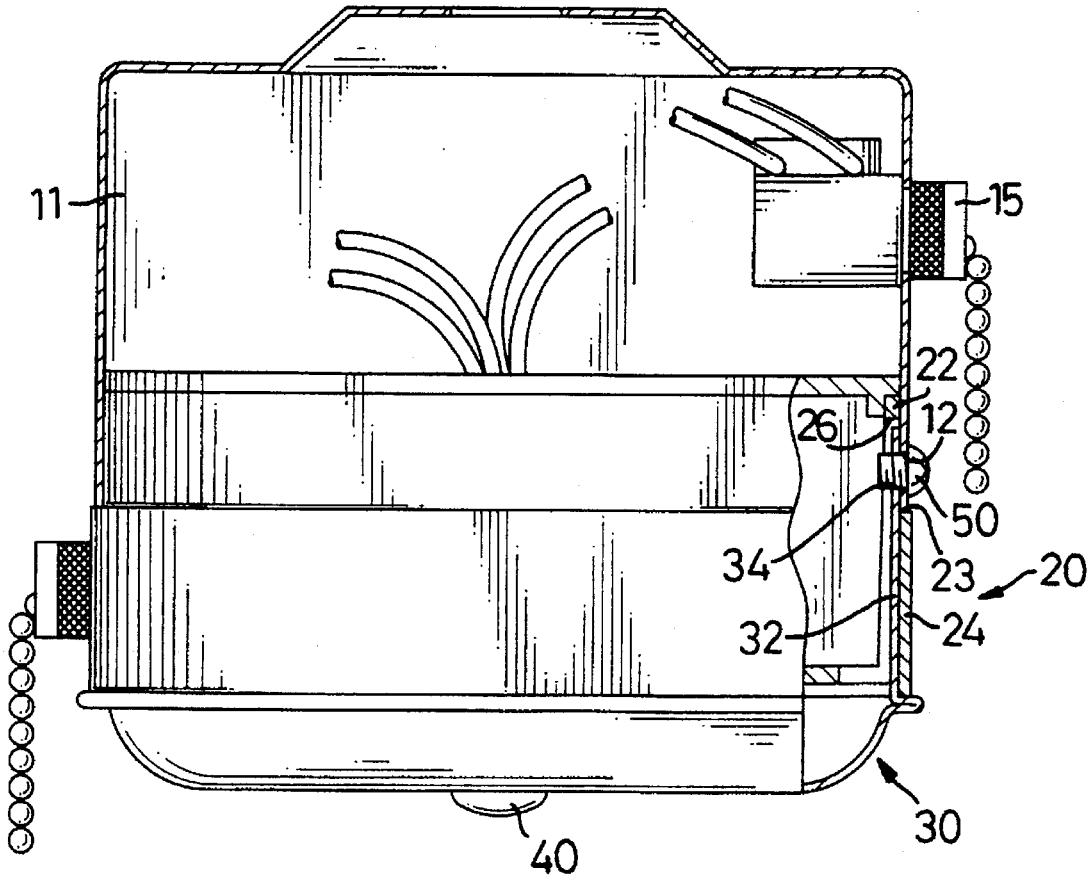
FIG. 3 is a front plan partially cross-sectional view of FIG. 2.

Referring to the drawings, a music box module in accordance with the present invention is adapted to be attached to a ceiling fan 10 which comprises a plurality of rotary blades 16 and a control box 11 disposed on an underside of the ceiling fan 10. The control box 11 contains a control switch 15 therein for controlling operation of the rotary blades 16. Three holes 12 are each transversely defined in a periphery of the control box 11.

The music box module comprises a music box 20 mounted in the control box 11 and having three slots 26 transversely defined in a periphery thereof and each aligning with a corresponding one of the three holes 12.

A supporting base 30 is mounted on an underside of the music box 20 and has three flanges 32 extending upwardly from a periphery thereof to be received in an inner wall of the music box 20. Each of the three flanges 32 has a bore 34 transversely defined by a threaded portion thereof and aligning with a corresponding one of the three slots 26.

Three positioning members 50 such as bolts, screws and the like each extend through a corresponding one of the three holes 12, an associated slot 26 and are each threadedly engaged in an associated bore 34, thereby securely mounting the music box 20 and the supporting base 30 on the control box 11 of the ceiling fan 10.

Preferably, the music box 20 has an upper periphery 22 and a lower periphery 24 with an outer diameter greater than that of the upper periphery 22, thereby forming an annular shoulder 23 therebetween such that the control box 11 can be supported on the shoulder 23.

Each of the three slots 26 is vertically defined through the upper periphery 22 of the music box 20 and extends through an inner wall of the lower periphery 24 of the music box 20 such that each of the three flanges 32 can be fully received in the associated slot 26.

The supporting base 30 has a socket 36 defined in an underside thereof, and an end cap 40 in the form of a plug 42 is mounted on the underside of the supporting base 30 and is fittingly received in the socket 36.

Accordingly, by such an arrangement, the music box 20 together with the supporting base 30 can be installed on the control box 11 without a tendency to interfere with a normal operation of the ceiling fan 10, thereby providing an efficient usage in the space of the control box 11 of the ceiling fan 10.

It should be clear to those skilled in the art that further embodiments of the present invention may be made without departing from the scope and spirit of the present invention.

What is claimed is:

1. A music box module for a ceiling fan which includes a control box mounted on an underside of said ceiling fan and at least one hole defined in a periphery of said control box, said music box module comprising:

a music box mounted in said control box and having at least one slot defined in a periphery of said music box and aligning with said at least one hole;

a supporting base mounted on an underside of said music box and having at least one flange extending upwardly from a periphery of said support base, said at least one flange being received in an inner wall of said music box, a bore defined by a threaded portion of said at least one flange and aligning with said at least one slot; and a positioning member extending through said at least one hole, said at least one slot, and securely engaged in said bore.

2. The music box module in accordance with claim 1, wherein said music box includes an upper periphery and a lower periphery having an outer diameter greater than an outer diameter of said upper periphery thus forming an annular shoulder between said upper and lower peripheries, and said control box is supported on said shoulder.

3. The music box module in accordance with claim 2, wherein said at least one slot is vertically defined through said upper periphery of said music box and extends through an inner wall of said lower periphery of said music box, and said at least one flange is received in said at least one slot.

4. The music box module in accordance with claim 1, wherein said supporting base has a socket defined in an underside of said supporting base, and an end cap is mounted on the underside of said supporting base and is fittingly received in said socket.

* * * * *